United States Patent [19]

Nette et al.

[11] Patent Number: 4,475,846

[45] Date of Patent: Oct. 9, 1984

[54] METHOD OF PLACING A WEB

[75] Inventors: Aart Nette, Werkendam, Netherlands; Jacob A. Kruyt, Bremen, Fed. Rep. of Germany

[73] Assignee: Hollandsche Beton Groep N.V., Netherlands

[21] Appl. No.: 233,613

[22] PCT Filed: May 2, 1980

[86] PCT No.: PCT/NL80/00015

§ 371 Date: Jan. 3, 1981

§ 102(e) Date: Jan. 2, 1981

[87] PCT Pub. No.: WO80/02437

PCT Pub. Date: Nov. 13, 1980

[51] Int. Cl.[3] ..... E02B 3/12; F16L 1/04

[52] U.S. Cl. ..... 405/17; 405/19; 405/168

[58] Field of Search ..... 405/17, 18, 19, 270, 405/154, 158, 166, 168; 166/338–343

[56] References Cited

U.S. PATENT DOCUMENTS

| | | | |
|---|---|---|---|
| 2,390,403 | 12/1965 | Van der Rest | 405/17 |
| 2,570,271 | 10/1951 | Pickett | 405/17 |
| 3,302,709 | 2/1967 | Postlewaite | 166/342 X |
| 4,090,337 | 5/1978 | Szekeres | 405/19 X |
| 4,260,288 | 4/1981 | Ellers et al. | 405/168 |

FOREIGN PATENT DOCUMENTS

| | | | |
|---|---|---|---|
| 2341479 | 2/1974 | Fed. Rep. of Germany | 405/19 |
| 2260051 | 8/1975 | France | 405/168 |
| 94410 | 1/1957 | Netherlands | 405/17 |

*Primary Examiner*—Cornelius J. Husar
*Assistant Examiner*—Nancy J. Stodola
*Attorney, Agent, or Firm*—Sughrue, Mion, Zinn, Macpeak & Seas

[57] ABSTRACT

A method and apparatus for laying a web in a submerged condition on an entrenchment floor includes wrapping a web onto a drum as said drum is floating on a water surface of the entrenchment, navigating the wrapped drum to a beginning section of the entrenchment, and unwinding the drum as it is floating on the entrenchment while further navigating the drum. Water is pumped from a section of the entrenchment already layed with the web, thus imparting an unwinding force to the drum and giving the web a convex shape along the portion of the web which extends from the drum to the entrenchment floor.

7 Claims, 5 Drawing Figures

METHOD OF PLACING A WEB

BACKGROUND OF THE INVENTION

The invention relates to a method of placing a web on an entrenchment below the ground water level. Usual methods of placing such a web consist of first draining the entrenchment at the start of a constriction project so that the web can be placed in a simple way. Draining the water does however also affect the ground water level in the area outside the entrenchment and therefore, draining is not always allowed at the beginning of a constrication project. A typical example is an entrenchment for a road near a wildlife habitat.

SUMMARY OF THE INVENTION

The invention provides a solution for the above problem. According to the invention, the solution is achieved by wrapping the web around a core or roll, floating the core or roll in either the entrenchment or a water course which is connected with the entrenchment, and subsequently navigating the wrapped-up core or roll to the beginning of the entrenchment, after which unwinding and attachment of the web takes place.

Such a web is preferably formed by connecting lengths of web material segments, cut off at size substantially parallel to the center line of the core or roll, to preceding lengths of web material segments. The web segments can be connected by welding or adhering.

The length of the core should substantially be equal to the resultant width of the entrenchment. If a road is concerned which has to be processed in this way, it is determined according to the invention, that the resultant width of the entrenchment is realized by enlarging the projected width by applying at least one flood verge.

Unwinding takes place after the core is positioned by pumping water from the entrenchment at the location where the web still has to be applied, to the location between the initial edge of the web and the core. During this pumping, a braking moment and braking force is preferably exerted on the core.

In order to apply the method according to the invention also a number of installations is necessary. The floating core is for instance formed so for that purpose, that, while being pivotal about its own axis by means of moment arms, it is connected to at least one pontoon, the pontoon being provided with winches to bring the core in the correct position.

Furthermore means are necessary to lower compression means with the aid of guide cables to secure the web edges, provided with ring eyes, to structure parts, positioned under water. For this purpose, the guide cables extend between screw eyes, present in a concrete clamping edge, to for instance auxiliary scaffolds or one or more derrick barges, dependent upon the nature of the intermediary structures. Preferably, barbed bars are provided between the guide cables and screw eyes.

BRIEF DESCRIPTION OF THE DRAWINGS

The invention will be further elucidated hereinafter on the basis of the drawings, in which by way of example an embodiment is shown of an installation to apply the method according to the invention. In the drawings.

DESCRIPTION OF THE PREFERRED EMBODIMENTS

Figure 1:
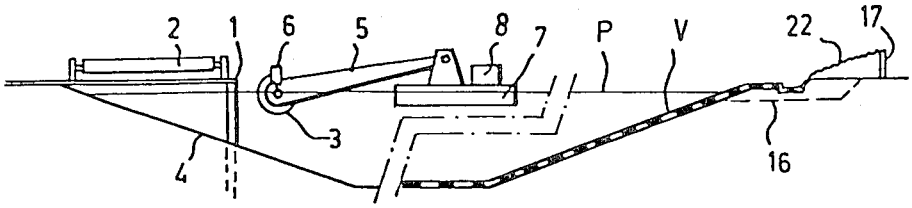
FIG. 1 an abridged cross-section of an entrenchment having some installations at the left adapted to be used when applying the method according to the invention, and having at the right an entrenchment profile with a flood verge under the water level, all this substantially according to the line I—I of FIG. 2.
Figure 2:
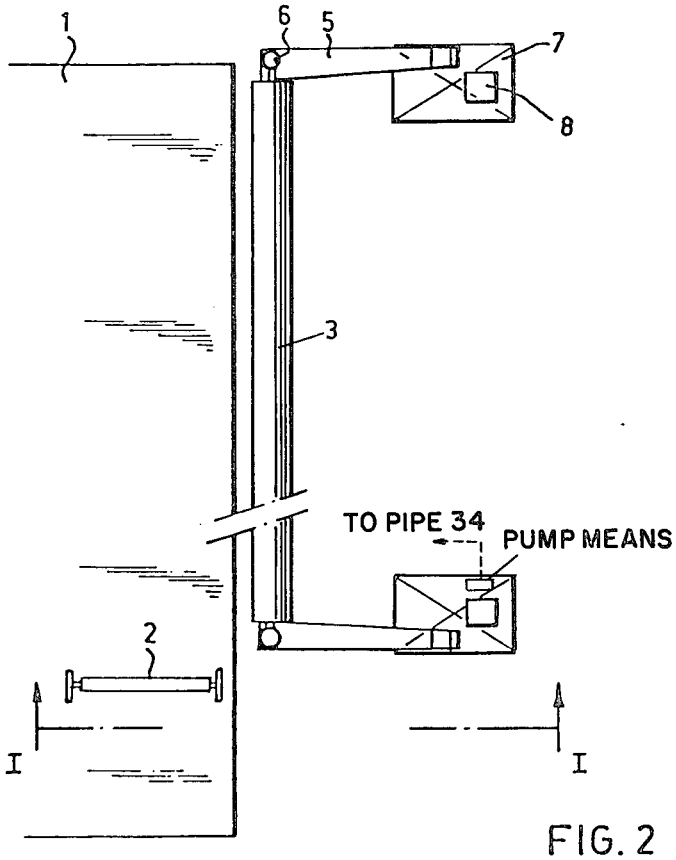
FIG. 2 shows a schematic plan view of the installations of FIG. 1.

In FIGS. 1 and 2, the equipment at the left includes a working floor 1 having a length which is equal to the resultant width of a web which is wound on a reel 2. The resultant width of the web may be, for example, 175 meters. Along the working floor 1, a core 3 can be moored, on which the web is wound. This is effected by winding the complete web V, necessary for one section, i.e., a part of the entrenchment between for instance two structures, including a triangle as a consequence of a possible oblique crossing of one of the structure parts, and the prefabricated web edges. It goes without saying that the entrenchment need not be rectangular in plan view, but may have any shape.

The drum is moored as closely as possible against the working floor, and the working floor may be over a slope 4. The drum 3 can comprise a steel tube having a diameter of approximately 1 meter and a wall thickness of approximately 12.5 millimeters. On the other hand, the web is very thin (up to a magnitude of 1 millimeter) by which only an increase in radius of some tens of centimeters is developed around the drum 3 for an entrenchment of approximately 400 meters. The working floor 1 can be located in the vicinity of the bank of the section to be dredged or a small channel which communicates with said section to be dredged.

The drum 3 is connected to two small pontoons 7 via two moment arms, which are connected to the drum via a hydromotor 6. This additional structure causes the total width of the roll with pertaining parts to be approximately 2 meters larger than the length of the core or roll itself. Winches 8 are provided on the pontoons, and the winches 8 are controllable both with respect to their tensile force and holding force. With the aid of the winches 8, the core or roll can be introduced into and maintained in any position within the dredged section.

Figure 5:
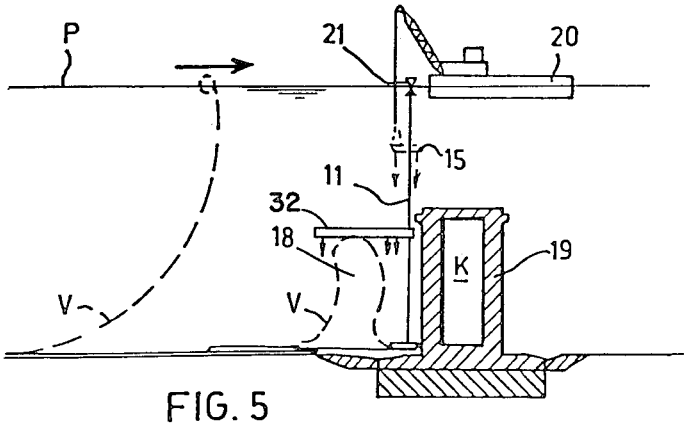
FIG. 5 shows a longitudinal section of an entrenchment at the location of a structure which does not protrude above the water level, on the basis of which the end of the web placing process is elucidated.

The initial and final operations when placing the web at the beginning and end of the entrenchment are most simple, as the web needs not be arranged under water in these situations. However, the situation at the location of the structures K is completely different, such as structures which protrude above the water surface P, as in FIG. 3, and structures which do not protrude above the water surface P, as in FIG. 5.

In the event the structure K obliquely intersects the entrenchment, the drum 3 can be manoeuvered to the extreme corner point of the respective section, and then the partly unwound point can be drawn onto an auxiliary scaffold 10 (FIG. 3), secured to a viaduct 9, and temporarily anchored. By further unwinding the roll and navigating it parallel to the viaduct 9, the total web edge can be brought onto the auxiliary scaffold 10. One will note then, that the complete triangle is between the roll and the viaduct in a folded manner, which, however, presents no disadvantage.

Before the roll or core 3 is navigated against the viaduct 9, spaced apart vertical guide cables 11 are prearranged from screw eyes 13 (FIGS. 3 and 4) located in a concrete clamping edge 12, to the auxiliary scaffold 10 to be arranged. The vertical guide cables 11 can be spaced approximately 3 meters apart from one another. The guide cables 11 are laced through ring eyes (not shown) present in the web edge. Furthermore the web edge is provided with some ballast, with the aid of which the web edge can be lowered along the guide cables.

A barbed bar 14 is placed between the guide cables 11 and the concrete clamping edge 12 (FIG. 4) which should prevent the web, when passed over the barbed bar 14 from sliding back. With sensors one can determine whether the web edge is in the required position and if not, it can be brought into the required position.

Figure 3:
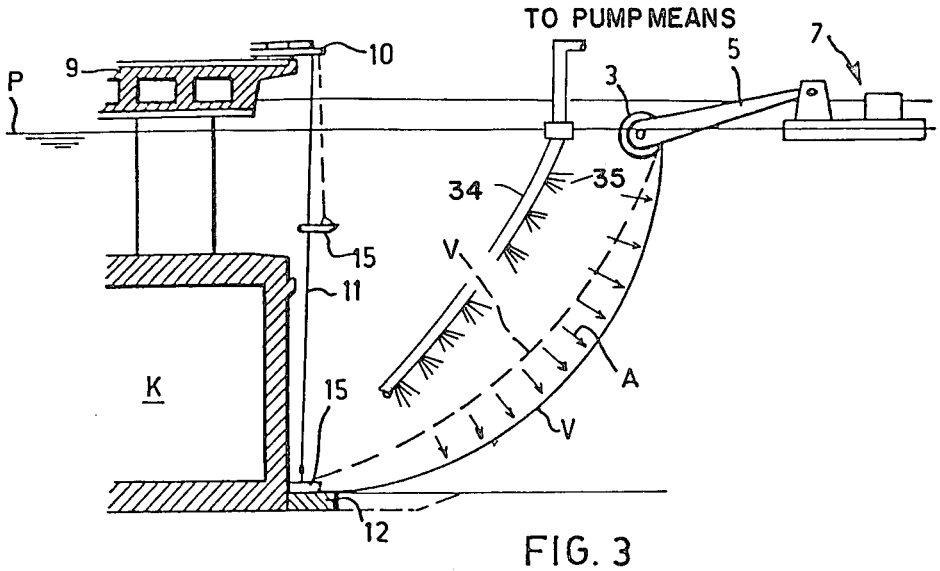
FIG. 3 shows a longitudinal section of an entrenchment at the location of a part of a structure protruding above the water, to elucidate the beginning of the web placing process.
Figure 4:
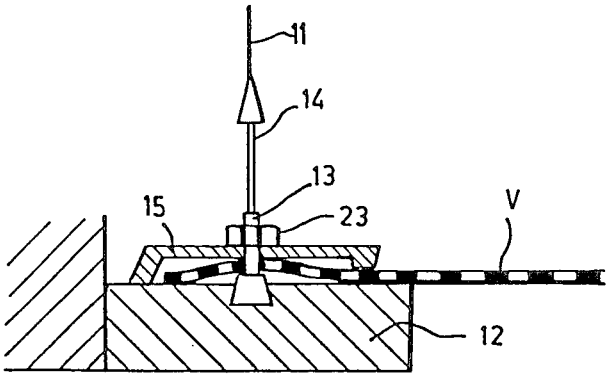
FIG. 4 shows details of the guide means of FIG. 3.

Before the clamping construction 15, weighing about 1 ton, can be arranged, it has to be certain that on its track laong the guide wires 11 it does not meet the web V, as this will undoubtedly cause damage. In FIG. 3 two clamping constructions 15 are visible. One clamping construction 15 is on an already provided clamping edge 12 of the structure K. The other clamping construction 15 is shown closer to the water surface P, and this latter clamping construction will be arranged next to the first one. Securing the clamping constructions 15 next to each other takes place by turning nuts 23 (FIG. 4) over the screw eyes 13. The guarantee that the web will not be damaged by the clamping constructions can be achieved by further turning the core or roll in a position perpendicular to the axis of the entrenchment, keep them under control, and then introducing a slight difference in water pressure by means of pumping over water. This exerts a pressure on the web, the pressure being indicated by arrows A in FIG. 3. Care should be taken, however, that the water that flows to create this pressure causes the least disturbance possible, and that is the reason that, for instance, a long spray pipe 34 must be sued for spraying a water spray 35 towards the web.

After having checked first whether the web does indeed leave the clamping edge 12 almost horizontally, the clamping units 15, which have a length of approximately 6 meters, can be payed out one by one from the auxiliary scaffold 10 along the guides wires 11 and screwed on with the aid of divers.

The web V can now be further payed out under a certain braking moment and braking force by pumping-over water, while care is furthermore taken that the core or roll will not become clamped against one of the banks.

It has to be remarked that a leak flow around the core heads or roll heads has an erosive effect. Therefore a light erosion protection of 0.1 meters of gravel on the slope is necessary. Furthermore one should realize that the resultant length may be approximately 5 meters longer than the projected one, which requires the provision of a flood verge, indicated at the right in FIG. 1 by means of a dashed line 16. It is also possible to solve this problem by including a fold on the core or roll.

In order to ensure that the web edge does not disappear under water, it is advisable to fix it with for instance pegs 17 (FIG. 1), which can then be connected by wires 22 to a ring eye (not shown), which is included in the reinforced web edge.

In a later stage the web edge has to be brought above the water and the flood verge has to be completed. This can be done by locally withdrawing the web edge from the opposite side of the section of the entrenchment and thereby enabling re-profiling the verge.

The connection of the web at the ends of the respective sections of the entrenchment takes place in a similar manner as described for the connection at the beginning at the location of a structure K.

A difference is, however, that a water enclosure 18 (FIG. 5) is introduced between the web and the bottom, i.e., under the fold, which can, however, be discharged by creating an overpressure relative to the ground water.

In order to ensure that the fold will be on the bottom, a sausage-like ballast or weight 32, which is connected at one side to the guide wires 11, can be lowered parallel to the axis of the entrenchment to create the above-mentioned overpressure so that the water in the water enclosure 18 is discharged.

The connection to the structure 19 (FIG. 5), which does not extend through the water level, is additionally complicated, so that one has to work from the water with a derrick barge 20. The guide wires 11 can then be tensioned by means of somewhat more robust floats 21.

Although the invention is elucidated hereabove on the basis of an application to an entrenchment for a road for automobile traffic in which the entrenchment is, in fact, required to be drained at some time in the future after the web has been laid, it is remarked that the invention method and the pertaining installations can also be used in situations where no draining at any point in time is permitted since no influence of the ground water level in the direct neighborhood is permissible. In this respect one may think of large closed reservoirs, like rubbish tips, water basins, swimming pools and the like reservoirs.

We claim:

1. A method for laying a web in a submerged condition on an entrenchment, comprising the steps of:

forming a web by joining sections of web material lengths together along edges extending substantially parallel to a center axis of a drum;

winding said web onto said drum as said drum is floating on a fluid surface;

navigating and floating said wound drum to a beginning section of said entrenchment to be laid;

unwinding said would drum while further navigating and floating said drum along a water surface of said entrenchment;

pumping water in said entrenchment from a section of said entrenchment where said web has not been laid to a section of said entrenchment between said beginning section of said entrenchment and said floating drum to decrease a radius of curvature of a convex surface of said web to aid in unwinding said web from said floating drum, said convex surface extending from said drum to a floor of said entrenchment; and a longitudinal axis of said drum being substantially parallel to said fluid surface as said drum is wound and said axis being substantially parallel to said water surface as said drum is navigated, floated and unwound.

2. The method claimed in claim 1 further comprising the step of:

exerting a braking moment and braking force on said floating drum while pumping said water.

3. The method claimed in claim 1 wherein a hydrometer is used for unwinding said drum.

4. An apparatus for laying a web in a submerged condition on an entrenchment comprising:

a floating drum;

a web formed by joining sections of web lengths together along edges extending substantially parallel to a center axis of said drum, said web being wound onto said floating drum as said drum is floated on a water surface;

means for navigating and floating said wound drum to a beginning section of said entrenchment to be laid;

means for unwinding said wound drum while further navigating and floating said drum along said water surface of said entrenchment;

means for pumping water in said entrenchment from a section of said entrenchment where said web has not been laid to a section of said entrenchment between said beginning section of said entrenchment and said floating drum to decrease a radius of curvature of a convex surface of said web to aid in unwinding said web from said drum, said convex surface extending from said drum to a floor of said entrenchment; and a longitudinal axis of said drum being substantially parallel to said water surface as said drum is wound and said axis being substantially parallel to said water surface as said drum is navigated, floated and unwound.

5. The method claimed in claim 4 wherein said unwinding means and said navigating means comprises at least one pivotable moment arm connected to said drum for rotating said drum;

at least one pontoon connected to said at least one pivotable moment arm; and at least one winch secured to said at least one pontoon for navigating said drum.

6. The apparatus claimed in claim 5 wherein a length of said drum is substantially equal to a width of said entrenchment.

7. The apparatus claimed in claim 4 or 5 wherein said unwinding means further comprises a hydrometer.

* * * * *